United States Patent [19]

Levingston

[11] 3,986,368

[45] Oct. 19, 1976

[54] LOAD EQUALIZING AND SHOCK ABSORBER SYSTEM FOR OFF-SHORE DRILLING RIGS

[75] Inventor: Clarence W. Levingston, Orange, Tex.

[73] Assignee: Levingston Shipbuilding Company, Orange, Tex.

[22] Filed: May 27, 1975

[21] Appl. No.: 581,107

[52] U.S. Cl. ..... 61/91; 254/105; 61/92

[51] Int. Cl.[2] ..... E02B 17/04

[58] Field of Search ..... 61/46, 46.5, 63; 254/105–110, 112; 114/.5 D

[56] References Cited

UNITED STATES PATENTS

| | | | |
|---|---|---|---|
| 2,992,812 | 7/1961 | Rasmussen et al. | 254/107 |
| 3,245,658 | 4/1966 | Sutton | 61/46.5 X |
| 3,392,534 | 7/1968 | Blenkarn | 61/46.5 |

*Primary Examiner*—Dennis L. Taylor

[57] ABSTRACT

A load equalizing system for a jack-up leg on a mobile off-shore drilling platform barge, wherein the leg has a plurality of rigidly interconnected generally parallel chords. Each of the chords is connected to the barge by a rack and pinion type jack assembly arranged for raising and lowering the leg relative to the platform and wherein lateral deflection of the leg by wave action or the like causes the chords to move vertically unequally relative to the barge. The improvement comprises a pair of hydraulic cylinder assemblies mounted between each of the jack assemblies and the barge, with the working axes thereof generally parallel with the longitudinal axis of the leg. Each cylinder assembly has a cylinder piston mounted therein and a piston rod connected to the piston and extending longitudinally therefrom. Each of the hydraulic cylinder assemblies has one end connected to the barge and the other end arranged for vertical bearing against the top of one of the jack assemblies. Conduit means are provided for interconnecting the fluid containing ends of the cylinders for permitting hydraulic fluid to be transmitted therebetween. Means are also provided for charging hydraulic cylinders with at least sufficient hydraulic fluid to maintain the piston rods at about mid-stroke, whereby unequal vertical loads on the chords are reduced by equalization of hydraulic pressure in the cylinders through the conduit means. In the shock absorbing mode, the system includes a plurality of accumulators, each of which is arranged for containing a quantity of gas. Second conduit means are arranged for interconnecting the cylinders with the accumulators. Means are also provided for pressurizing the accumulators with gas whereby shock force exerted on the leg, as would be caused by heaving of the barge during raising and lowering of the leg, are absorbed by displacement of hydraulic fluid from the cylinder to the accumulators and compression of the gas therein.

10 Claims, 5 Drawing Figures

LOAD EQUALIZING AND SHOCK ABSORBER SYSTEM FOR OFF-SHORE DRILLING RIGS

BACKGROUND OF THE INVENTION

1. Field of the Invention

This invention relates to off-shore drilling rigs and more particularly to a load equalizing and shock absorber system for a jack-up leg on a mobile off-shore drilling barge.

2. Description of the Prior Art

As is well known in the art of drilling and producing off-shore wells for oil and gas, one of the methods used is to provide a working platform that is jacked up above the surface of the water having three or more legs implanted on the sea floor. One method of jacking up the platform is by use of a rack and pinion jacking system. Generally the legs for such a unit consist of a tower using three or more chord members with lacing members between the chords. When these legs are subjected to the forces and moments produced by high waves, wind and current, the leg bends. As the leg bends, a differential vertical deflection occurs between chord members on the opposite sides of the leg. This phenomenon tends to reduce the loading in one chord member and increase the load in the opposite chord member. This also causes unequal loading of the jack pinions. When the sea load is light to moderate, these vertical deflections are relatively small and can be absorbed by resilient pads between the jacks and the point of support. When the sea load is extremely high, the deflections increase to the point that it is impractical to absorb them solely with resilient pads.

When offshore mobile jack-up drilling units, as described above, are moved onto or off of a location in a seaway, the legs are lowered or raised relative to the platform and the lower ends of the legs strike the seabed as the platform responds to the vertical motions of the waves. In some cases, this has caused severe damage to the legs and/or to the platform. One method that has been used to overcome this problem is to use resilient shock pads mounted between the jack frame and the point of support. When using this method, the wave height in which the unit can be safely moved onto or off of a location is dependent on the shock absorbing characteristics of the resilient shock pads. As the wave height increases, a point is quickly reached where it is impractical to provide shock pads that can absorb the energy produced by the downward motion of the platform and legs, as the legs strike a hard bottom.

SUMMARY OF THE INVENTION

It is, therefore, an object of this invention to provide an improved load equalizing and shock absorber system between the legs and the barge on an off-shore drilling rig which will overcome the aforesaid problems.

Briefly stated, this invention is for a load equalizing system for a jack-up leg on a barge type drilling platform, wherein the leg is supported by the platform during movement of the platform to location offshore and wherein the leg engages the sea bottom and supports the platform when on location. The system is applicable to a leg which has at least two rigidly interconnected generally parallel chords and each of said chords is connected to the platform by a jack assembly arranged for raising and lowering the leg relative to the platform. The system comes into play when lateral deflection of the leg tends to cause the chords thereof to move vertically unequally relative to the platform. Hence, the invention includes at least one hydraulic cylinder assembly mounted between each of the jack assemblies and the platform with the working axes of the cylinders being generally parallel with the longitudinal axis of the leg. Each of the cylinder assemblies has a piston mounted therein and a piston rod connected to the piston and extending longitudinally therefrom. Each of the hydraulic cylinder assemblies has one end connected to the platform and the other end arranged for vertical bearing against a portion of one of the jack assemblies. Conduit means are provided for interconnecting the fluid containing ends of the cylinders and permitting hydraulic fluid pressure to be transmitted therebetween. A quantity of hydraulic fluid is contained in each of the cylinders to normally maintain the piston rods at least about mid-stroke, whereby unequal vertical loads on the chords caused by lateral deflection of the leg are reduced by equalization of hydraulic pressure in the cylinder through the conduit means. When the system is working in the shock absorber mode, it includes a plurality of compressible fluid reservoirs, each of which has a conduit interconnecting the fluid containing end of one of the cylinders, and means for pressurizing the accumulators with a compressible fluid such as gas, whereby shock forces are absorbed by compression of the gas when the pistons are retracted in response to shock forces exerted between the leg and the platform. The system has particular utility in connection with drilling barges having jack assemblies of the rack and pinion type, wherein it is desirable to reduce shock forces thereagainst also.

DESCRIPTION OF THE PREFERRED EMBODIMENT

Figure 1:
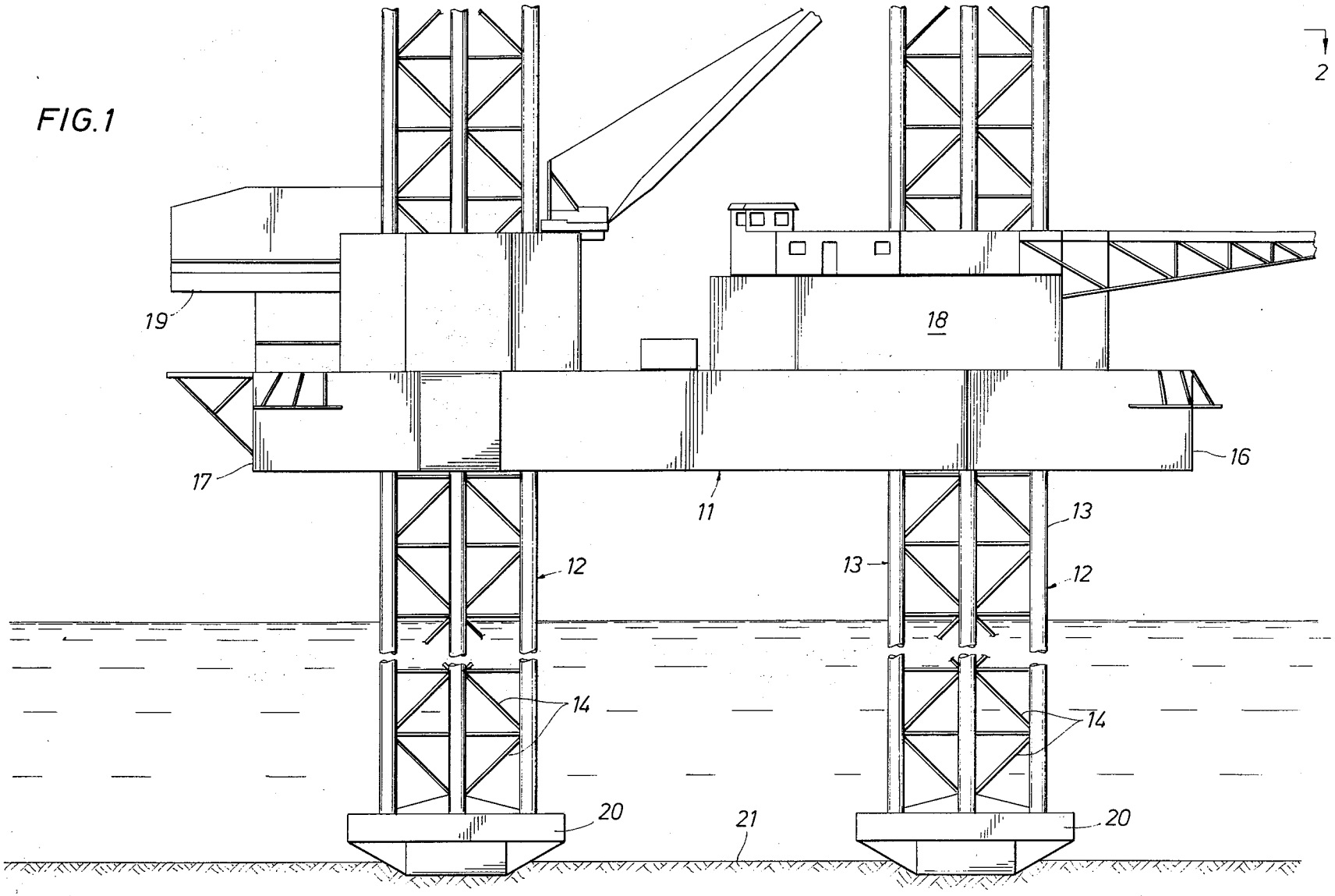
FIG. 1 is an outboard profile or side elevation view of a drilling platform of the type contemplated by this invention.

Referring now to FIG. 1, the numeral 11 generally designates a drilling barge platform of the type to which the present invention is applicable. It is shown supported on three legs 12, each of which is comprised of four generally parallel chords 13 which are rigidly interconnected by a plurality of lacing members 14, which act as braces.

Figure 2:
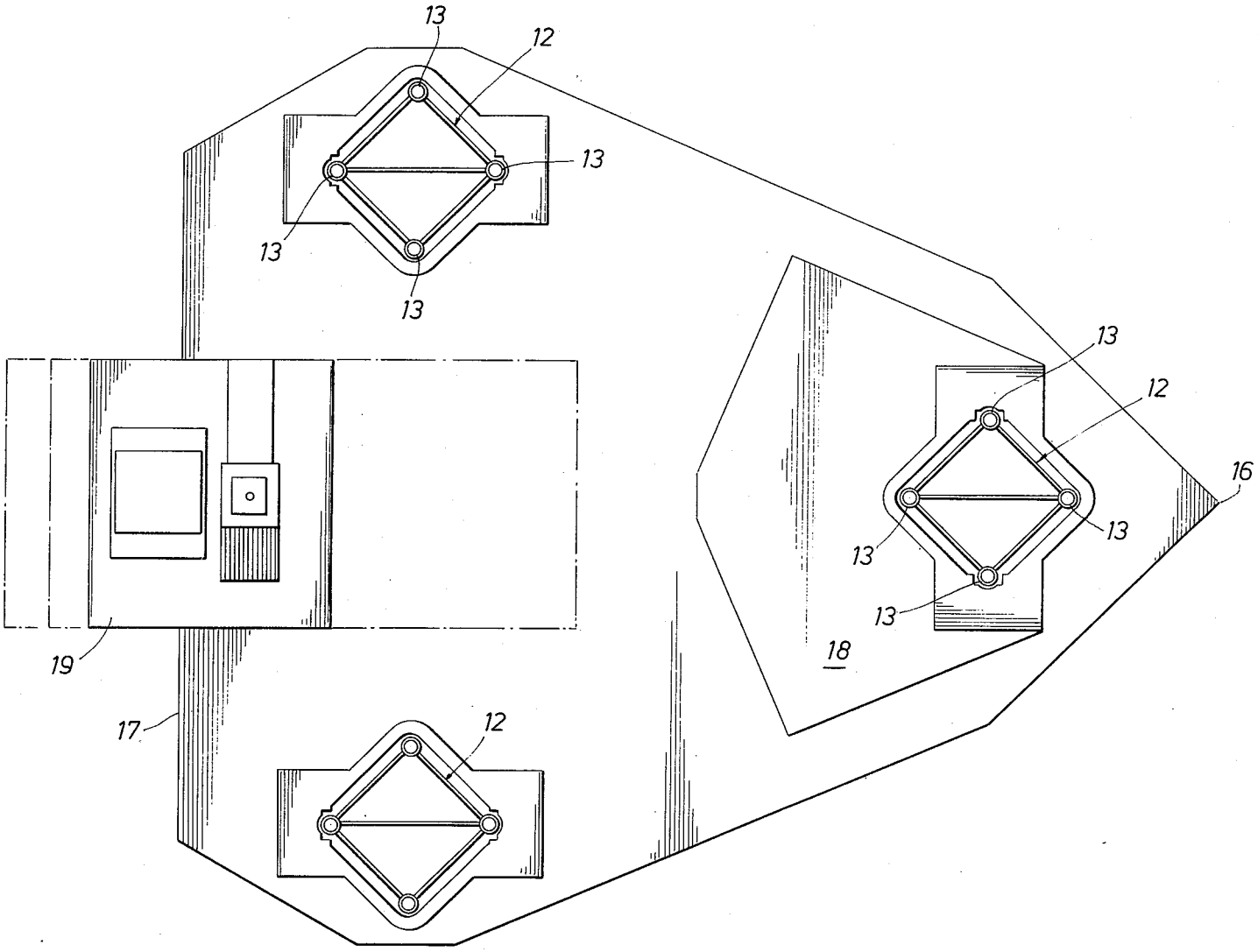
FIG. 2 is a top plan view generally taken along line 2—2 of FIG. 1.

It is to be understood that drilling barge platform 11 is of the type which is arranged for floating in a body of water and which can be towed to the off-shore location where the drilling is to be performed. More particularly, drilling barge platform 11 has a forward bow 16 and a stern 17 as seen in FIG. 2. The forward portion of platform 11 has mounted thereon conventional crew quarters 18 and at the rearward area thereof, there is mounted thereon a movable derrick floor 19, all of the foregoing of which is well known to those skilled in the art.

When platform 11 is being towed to the off-shore location, legs 12 will be retracted or raised upwardly with respect to platform 11, such that platform 11 floats in the water. At such time as the platform 11 reaches the point over which drilling is to be performed, legs 12 are lowered relative to platform 11, such that the base pads 20 of each of the legs 12 contact sea bottom 21 and ultimately raise drilling barge platform 11 to the raised position shown in FIG. 1, for example. During the lowering of legs 12 as discussed above, the lower end of legs 12 oftentimes strike sea bottom 21 as platform 11 responds to vertical motion caused by wave action. In one mode of operation of the system, it is arranged for absorbing such shock so as to reduce the shock forces on the jack assemblies, which are supporting the legs, and to reduce possible damage to legs 12 themselves. Once the platform 11 has been raised to the position shown in FIG. 1, then it is also desirable to operate the system so as to equalize vertical loads on chords 13 of any of legs 12, which unequal vertical loading is caused by lateral deflection of the leg, as discussed above.

Figure 3:
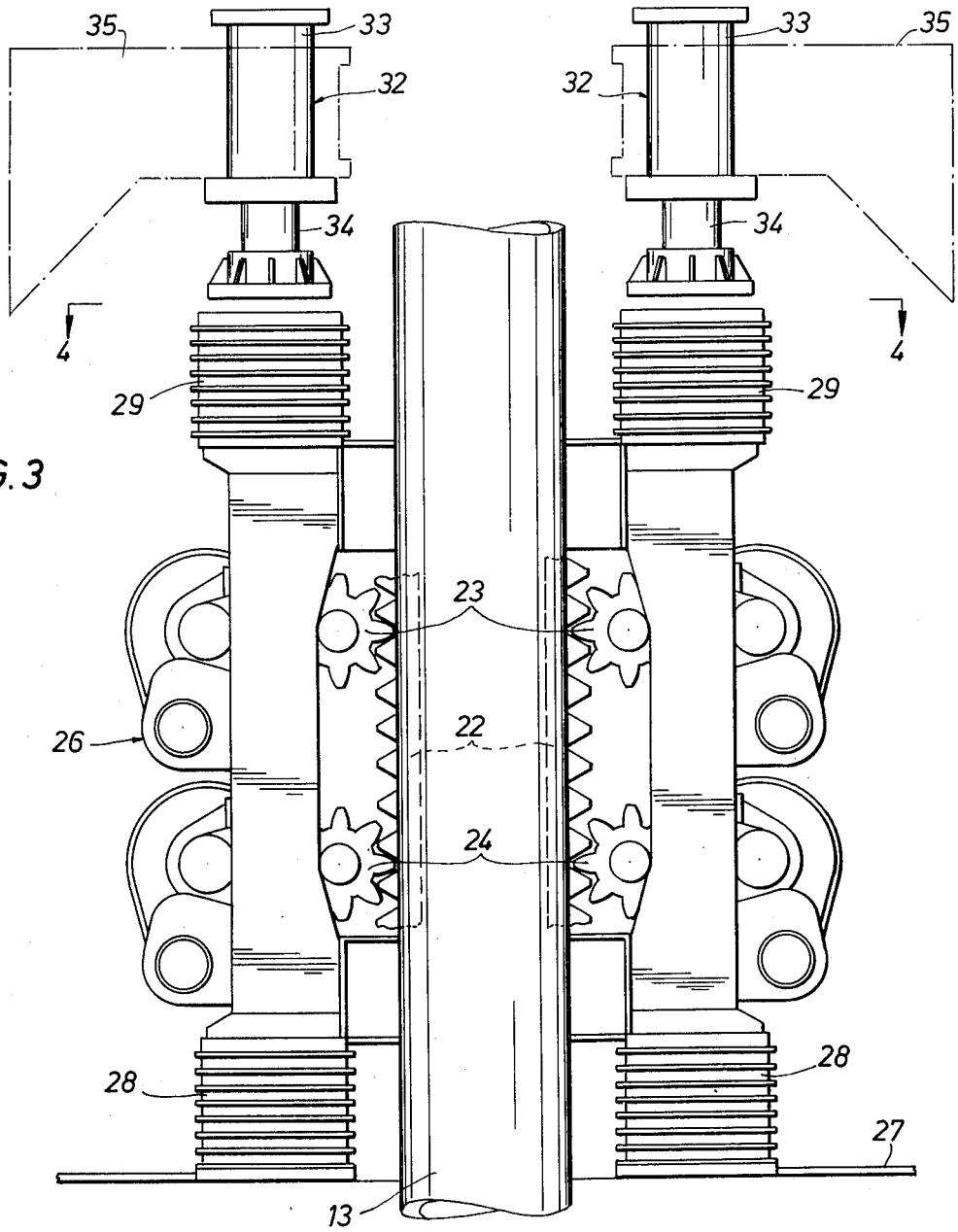
FIG. 3 is a side elevation view of one of the jack assemblies associated with one of the chords and showing portions of the load equalizing and shock absorbing system of this invention.
Figure 4:
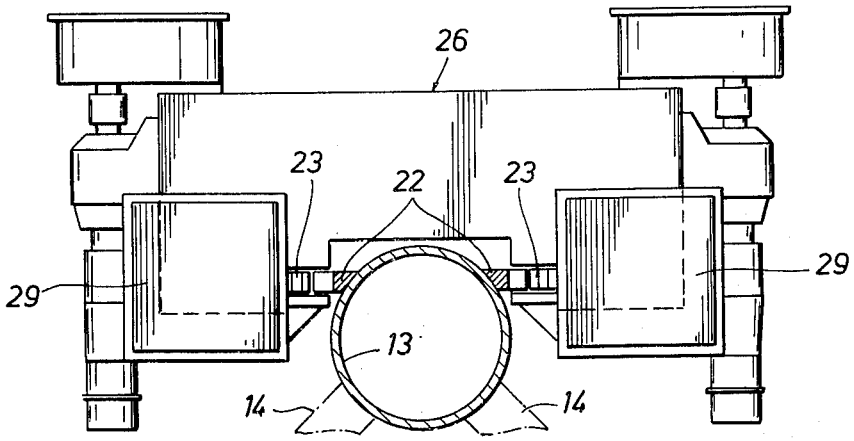
FIG. 4 is a cross-sectional view taken generally along line 4—4 of FIG. 3.

Referring now to FIGS. 3 and 4 in particular, each of the chords 13 is generally tubular in shape and has mounted on opposite sides thereof and extending vertically therealong a gear rack 22, each of which is arranged for engagement by an upper pinion gear 23 and a lower pinion gear 24, which form part of the jack assemblies generally designated by the numeral 26. Jack assemblies 26 are of the electric motor type, having electromagnetic friction brakes, with the motors thereof arranged through appropriate gear trains for turning upper and lower pinion gears 23 and 24 in the desired directions for either raising or lowering chords 13 relative to jack assemblies 26.

Jack assemblies 26 are supported on main deck 27 by two stacks of lower shock pads 28 which assist in dampening compression forces between jack assembly 26 and main deck 27. In addition, each jack assembly 26 has mounted on the top thereof two stacks of upper shock pads 29. Each of the stacks of shock pads 29 has mounted thereover a hydraulic cylinder assembly designated by the numeral 32.

Each of the hydraulic cylinder assemblies 32 is comprised of a hydraulic cylinder 33 having a piston therein (not shown) connected to a piston rod 34, which extends downwardly therefrom and is arranged for abutment with the upper end of one of the stacks of upper shock pads 29. The cylinders 33 in the embodiment shown are connected to upper guide structure 35 which is rigidly connected to platform 11 and forms a part thereof. It will be noted that upper shock pads 29 are arranged to accommodate compression forces between jack assembly 26 and upper guide structure 25 when contacted by the lower end of rod 34. It is also to be understood that the contacting surfaces between the lower ends of rods 34 and the upper surface of the upper shock pads 29 associated therewith are provided with a greased innerface.

Figure 5:
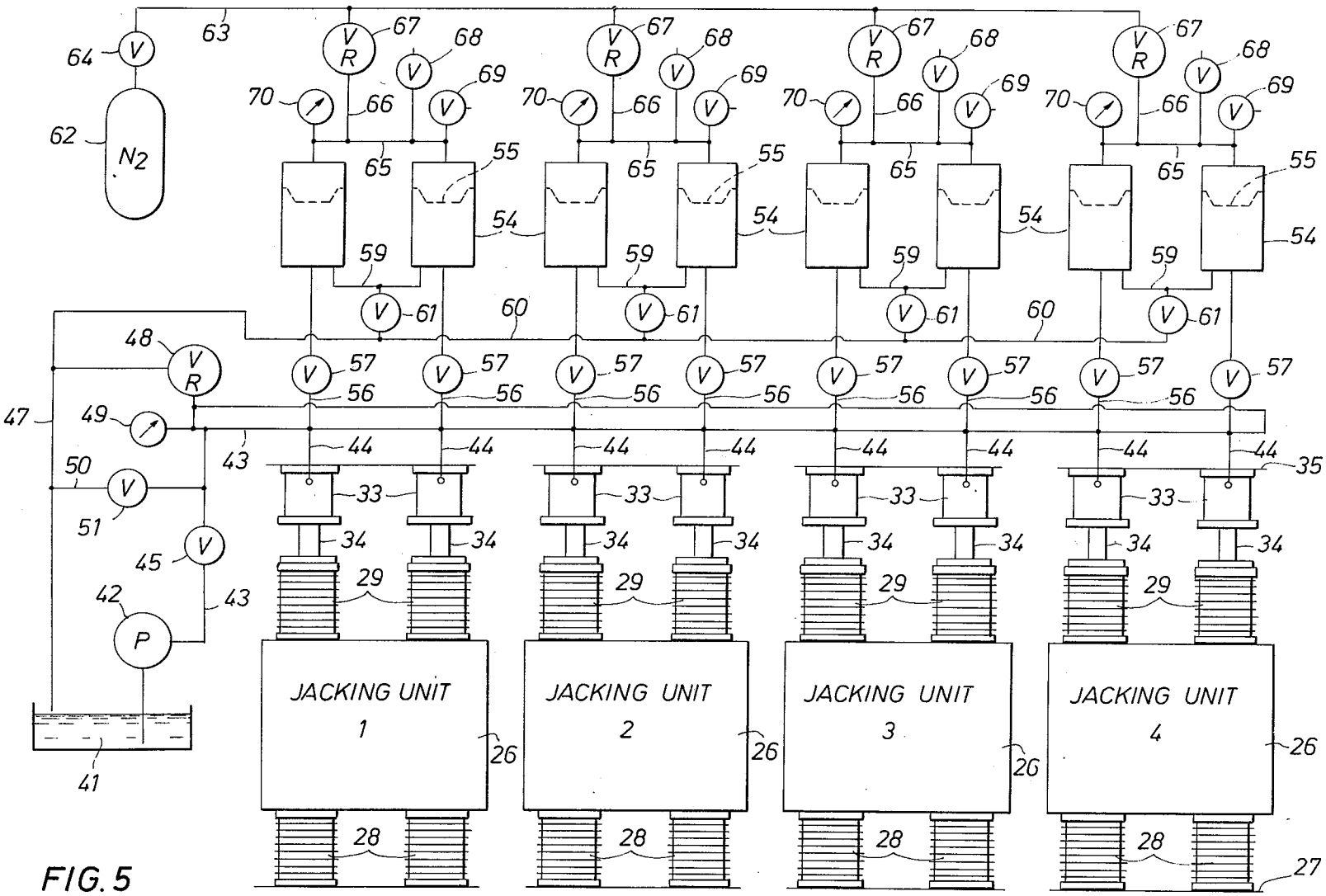
FIG. 5 is a schematic diagram of the system of this invention, which is arranged for operation either in the load equalizing mode or in the shock absorber mode.

Referring now to FIG. 5, means for charging hydraulic cylinders 33 with sufficient hydraulic fluid to maintain piston rods 34 in the desired stroke position and the conduit means for interconnecting the fluid containing ends of the cylinders will now be explained. There is provided a sump tank 41 containing an adequate supply of hydraulic fluid from which hydraulic fluid is arranged to be pumped by hydraulic pump 42, the output of which is applied to line 43, which is connected by branch lines 44 to the fluid or upper end of each of the cylinders 33, as shown. Line 43 is provided with an appropriate valve 45 for controlling and maintaining the desired quantity of hydraulic fluid in the system, as will be described hereinafter. The return portion of line 43 is connected to return line 47 through regulator valve 48. Return line 47 is arranged for discharging into tank 41. Pressure on line 43 is arranged for monitoring by pressure gauge 49. It will be observed that the fluid end of each of the hydraulic cylinders are all interconnected through branch lines 44 and line 43. A release line 50 is also provided between line 43 and line 47 and has a valve 51 positioned therein for controlling fluid flow therethrough.

When operating in the shock absorbing mode, the system includes a plurality of compressible fluid reservoirs in the form of hydraulic accumulators 54, each of which have a movable piston 55 therein and arranged for containing hydraulic fluid on the lower side thereof and a compressible fluid such as gas on the upper side thereof. Each accumulator 54 is arranged for interconnection with the fluid side of a hydraulic cylinder 33 by means of a branch line 56 which is connected to both a line 44 and line 43, as shown. In addition, each of the lines 56 is provided with a valve 57 for controlling fluid flow therethrough.

Means are also provided for bleeding hydraulic fluid from accumulators 54 back to tank 41, and these bleed means are conveniently in the form of drain lines 59 connected to the bottom of each pair of hydraulic accumulators 54, which drain lines are coupled with return drain line 60 through a bleed valve 61. It will be noted that return drain line 60 is connected with return line 47, such that hydraulic fluid can flow to tank 41, as aforesaid.

Means are provided for charging accumulators 54 with compressible fluid such as gas, and these means conveniently take the form of a tank 62 containing a supply of compressed nitrogen, for example, which is coupled to pressure line 63 through control valve 64. Each pair of accumulators 54 is provided with a charging line 65 which communicates with the upper ends thereof and which are connected through branch lines 66 to line 63. Each branch line 66 has mounted therein a regulator valve 67. Each charge line 65 has attached thereto a vent valve 68, a regulator valve 69 and a pressure gauge 70. Upon opening of valve 64, pressurized nitrogen is applied on line 63 through valves 67 to lines 65 and thence to the upper portion of hydraulic accumulators 54.

The operation of the system will now be explained in three sequences, i.e. moving to location, operating at the location, and getting off the location. Initially, it will be assumed that platform 11 is afloat in a body of water and ready to be towed to an off-shore drilling site. To place the system in operation, valves 57 are opened, permitting fluid communication between hydraulic cylinders 33 and accumulators 54. Vent valves 68 are then opened to vent unwanted gas from the system. Hydraulic pump 42 is then actuated and valve 45 opened, with the result that hydraulic fluid is flowed through line 43, branch lines 44 to hydraulic cylinders 33. In addition, hydraulic fluid is flowed to the lower sides of hydraulic accumulators 54 through lines 56. Pumping is continued until a pressure of 50 PSI is achieved throughout the system, which will cause the purging of air from the gas side of the accumulators 54 and completely fill the system. At this point, vent valves 68 will be closed and bleed valves 61 are opened. Nitrogen valve 64 is then opened and regulator valves 67 set at the desired pressure so that each accumulator 54 is charged to approximately 185 PSI, at which point valve 64 is closed. Regulator valves 69 will be adjusted to the desired pressure setting to avoid damage to the system if pressure exceeds too high a level, as for example 3300 PSI. The foregoing charging of accumulators 54 will move pistons 55 therein to the bottom position and force air out of the oil side of accumulators 54 through bleed valves 61. At this point, pump 42 is again started and valve 45 opened such that oil is then circulated through bleed valves 61 to purge the remainder of unwanted air from the system, at which point pump 42 is stopped, valve 45 is closed, as are valves 61.

Assuming that platform 11 is then positioned over the drilling point, legs 12 are lowered by operation of jack assemblies 26, as described above. As the legs 12 strike the bottom due to the heaving of the vessel caused by wave action, pistons 34 will stroke upwardly, displacing hydraulic fluid from cylinders 33 to the lower sides of accumulators 54, which in turn compresses the nitrogen on the upper sides of accumulators 54, to thereby absorb the shock forces. Hence, accumulators 54 act as shock absorbers which not only prevent damage to the lower end of the legs 12, but also prevent damage to the jack assemblies and possible damage to the platform, as well. The jacking operation is continued until barge platform 11 is raised to the desired height above sea level, as for example, to the position shown in FIG. 1. As may be seen, all accumulators 54 and cylinders 33 for any one leg are in fluid communication with each other and, therefore, may perform some load equalization function (as described below) in the "shock-absorbing" mode of the system. At this point, the barge platform 11 is fully supported by legs 12 with the result that gas pressure in accumulators 54 may be on the order of two to three thousand PSI.

Vent valves 68 are then opened slowly and nitrogen pressure is reduced to the order of 10 PSI. Hydraulic pump 42 is again started up and valve 45 opened. Hydraulic pressure then is applied on line 43 and to hydraulic cylinders 33 until pistons 34 are about the midstroke position. Hydraulic pump 42 is then stopped and all valves shown in the system in FIG. 5 are placed in the closed position. Thus arranged, the system is then in the load equalizing mode of operation and arranged for equalizing the vertical loads on the chords 13 caused by lateral deflection of legs 12 which may occur as a result of wave action arising during a storm. In this mode, it will be observed that each hydraulic cylinder 33 is in fluid communication with the other hydraulic cylinders 33 through lines 44 and line 43. Accordingly, as one chord 13 moves vertically upward relative to platform 11, which would otherwise cause an increase in vertical loading, hydraulic fluid is displaced from hydraulic cylinders 33 associated with that particular chord and applied to the hydraulic cylinders associated with the other chords.

As explained above, extremely high waves and strong wind action applied laterally to a leg 12 causes the leg to bend considerably. As this bending occurs, the opposite leg chords 13 deflect vertically by as much as several inches in some cases. The subjects the windward chord 13 to excessive vertical loading in addition to the compressive loading due to the bending moment in the leg 12. At the same time, such action decreases the vertical loading on the leeward chord 13. This also produces unequal and excessive loads on the jack pinions 23 and 24. With the system just described and as the vertical deflection of the chords 13 occurs, the piston rod 34 on one side of the leg 12 moves up and the piston rod 34 on the other side moves down, thus equalizing the vertical load on all of the chords 13 and the jack assemblies 26 of a particular leg.

When it becomes desirable to move barge platform 11 off location, bleed valves 61 are opened and valve 64 is opened and the accumulators 54 are charged with nitrogen to a pressure of about 185 PSI, for example, at which point valves 64 and 61 are closed. Hydraulic pump 42 is then actuated and valve 45 is opened. Fluid is then pumped through the system on line 43 until piston rods 34 are fully extended, at which point valve 45 is closed and pump 42 is stopped. Valves 57 are then opened with the result that piston rod 34 will be retracted by action of the load of the hull, which thereby forces hydraulic fluid into the lower portions of accumulators 54. Thereafter, jack assemblies 26 are operated so as to lower platform 11 on legs 12 until platform 11 is floating. As platform 11 becomes buoyant, piston rods 34 will be fully extended initially. Operation of jack assembly 26 is continued so as to start the upward retraction of legs 12 from contact with sea bottom 21. As legs 12 lift off bottom, hydraulic accumulators 54 again act as shock absorbers when the platform 11 is heaving due to wave action, causing legs 12 to hit the bottom. When legs 12 are raised sufficiently to clear sea bottom 21, there will be no load on piston rods 34 and accumulator pressure will be at approximately 185 PSI. If the system is not thereafter distrubed, it will then be ready for getting on the next location and the operational sequence can then be repeated without the initial or above described purging and charging steps.

In a typical installation, the pistons in hydraulic cylinders 33 may be of a diameter on the order of 20 inches, for example, and have a stroke of 12 inches. The working pressure for the hydraulic cylinders 33 may be on the order of 5100 PSI, for example. Regulator valve 48 would hence be set at a pressure range, as for example, 5500 PSI to prevent any damage to the system should pressure in the system exceed that level.

It is believed that the foregoing system describes a novel arrangement for providing both a load equalizing and shock absorber system to overcome the problems heretofore associated with unequal load forces on drilling platform legs and for compensating or providing for shock absorbing means during movement to and from a location.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken at the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A load equalizing system for a jack-up leg on a barge type drilling platform wherein the leg is supported by the platform during movement of the platform to location and said leg engages the sea bottom and supports said platform when on location and wherein said leg has at least two rigidly interconnected generally parallel chords and each of said chords is connected to said platform by a jack assembly arranged for raising and lowering said leg relative to said platform and wherein lateral deflection of said leg tends to cause said chords to move vertically unequally relative to said platform, the improvement comprising:

at least one hydraulic cylinder assembly mounted between each of said jack assemblies and said platform, with the working axes thereof generally parallel with the longitudinal axis of said leg, and each of said cylinder assemblies having a cylinder, a piston mounted therein, and a piston rod connected to said piston and extending longitudinally therefrom;

each of said hydraulic cylinder assemblies having one end connected to said platform and the other end arranged for vertical bearing against a portion of one of said jack assemblies;

conduit means interconnecting the fluid containing ends of said cylinders for permitting hydraulic fluid pressure to be transmitted therebetween;

and a quantity of hydraulic fluid contained in each of said cylinders to normally maintain said piston rods at least about mid-stroke, whereby unequal vertical loads on said chords caused by lateral deflection of said leg are reduced by equalization of hydraulic pressure in said cylinders through said conduit means.

2. The invention as claimed in claim 1 including:

a plurality of compressible fluid reservoirs each of which has a conduit interconnecting with the fluid containing end of one of said cylinders;

and means for pressurizing said reservoirs accumulators with a compressible fluid whereby shock forces are absorbed by compression of said fluid when said pistons retract in response to shock forces exerted between said leg and said platform.

3. The invention as claimed in claim 1 wherein said system includes:

a pair of said hydraulic cylinder assemblies mounted between said jack assembly and said platform.

4. The invention as claimed in claim 1 wherein:

said platform includes an upper support structure rigidly attached thereto;

and said hydraulic cylinder assembly is mounted between the top of said jack assembly and said upper support structure.

5. The invention as claimed in claim 1 wherein:

each of said chords has mounted thereon a gear rack;

and said jack assembly includes at least one pinion gear arranged to engage said gear rack, whereby rotation of said gear causes vertical movement of said chord relative to said platform.

6. The invention as claimed in claim 2 wherein:

said reservoirs are in the form of hydraulic accumulators each having valve means at the lower end thereof for bleeding hydraulic fluid therefrom and another valve means at the upper end thereof for bleeding gas therefrom.

7. The invention as claimed in claim 6 including:

pump means for charging said cylinders and accumulators with hydraulic fluid.

8. The invention as claimed in claim 6 including:

a source of pressurized gas connected to said accumulator for charging said accumulator with gas as desired.

9. A load equalizing system for a jack-up leg on a mobile off-shore drilling barge wherein said leg has a plurality of rigidly interconnected generally parallel chords and with each of said chords connected to said barge by a rack and pinion type jack assembly arranged for raising and lowering said leg relative to said platform and wherein lateral deflection of said leg by wave action or the like causes said chords to move vertically unequally relative to said barge, the improvement comprising:

a pair of hydraulic cylinder assemblies mounted between each of said jack assemblies and said barge, with the working axes thereof generally parallel with the longitudinal axis of said leg, and each cylinder assembly having a cylinder, a piston mounted therein, and a piston rod connected to said piston and extending longitudinally therefrom;

each of said hydraulic cylinder assemblies having one end connected to said barge and the other end arranged for vertical bearing against the top of one of said jack assemblies;

conduit means for interconnecting the fluid containing ends of said cylinders for permitting hydraulic fluid to be transmitted therebetween;

and means for charging said hydraulic cylinders with at least sufficient hydraulic fluid to maintain said piston rods at about mid-stroke, whereby unequal vertical loads on said chords are reduced by equalization of hydraulic pressure in said cylinders through said conduit means.

10. The invention as claimed in claim 9 including a plurality of accumulators, each of which is arranged for containing a quantity of compressible fluid;

second conduit means interconnecting each one of said cylinders and one of said accumulators;

and means for pressurizing said accumulators with gas, whereby shock force exerted on said leg is absorbed by displacement of hydraulic fluid from said cylinder to said accumulator and compression of said gas in said accumulators.

* * * * *